US006374061B1

(12) United States Patent
Williams

(10) Patent No.: US 6,374,061 B1
(45) Date of Patent: Apr. 16, 2002

(54) POWERED STAPLE REMOVER AND A DOCUMENT REPRODUCTION MACHINE HAVING SAME

(75) Inventor: Ernest B. Williams, Welwyn Garden City (GB)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/697,257

(22) Filed: Oct. 27, 2000

(51) Int. Cl.[7] ..... G03G 15/00; B25C 11/00
(52) U.S. Cl. ..... 399/1; 254/28
(58) Field of Search ..... 399/1, 407, 410; 254/28; 227/63; 270/1.01, 58.01, 58.08

(56) References Cited

U.S. PATENT DOCUMENTS

| | | | | | |
|---|---|---|---|---|---|
| 4,455,736 A | * | 6/1984 | Owen | 254/28 X |
| 4,473,220 A | | 9/1984 | Hovens et al. | 270/58.08 |
| 4,903,945 A | | 2/1990 | Wang | 254/28 |
| 5,583,628 A | * | 12/1996 | Parks | 399/1 X |
| 5,653,424 A | * | 8/1997 | Khan | 254/28 |

FOREIGN PATENT DOCUMENTS

| | | | |
|---|---|---|---|
| JP | 06-186809 | * | 7/1994 |
| JP | 08-155858 | * | 6/1996 |
| JP | 08-208111 | * | 8/1996 |
| JP | 09-197749 | * | 7/1997 |
| JP | 2000-159449 | * | 6/2000 |

* cited by examiner

*Primary Examiner*—Sophia S. Chen
(74) *Attorney, Agent, or Firm*—Tallam Nguti

(57) ABSTRACT

A powered staple remover including an elongate member for holding between a thumb and fingers of a user's hand. The elongate member has walls defining a cavity, a first end, a second end, and an opening into the cavity through the second end. The powered staple remover also includes first and second staple crown grippers mounted within the cavity towards the second end, at least one gripper of the first and second staple crown grippers is moveable towards the other. The powered staple remover further includes a powered device connected to the at least one gripper for moving the at least one gripper from an open to a closed position, and from and towards the second end, thereby effortlessly and effectively removing a clinched staple from a stapled set of sheets without damage to the set of sheets. The powered staple remover includes an attaching device for attaching the elongate member to an electrostatographic reproduction machine.

17 Claims, 4 Drawing Sheets

POWERED STAPLE REMOVER AND A DOCUMENT REPRODUCTION MACHINE HAVING SAME

BACKGROUND OF THE INVENTION

This invention relates to electrostatographic copying machines, and, in particular, to such a machine including a powered staple remover for removing and retaining staples from a staple set of document sheets.

Copying or reproduction machines include but are not limited to electrostatographic process machines. Generally, however, the process of electrostatographic copying or reproduction machines, such as light lens or scanner type machines, includes uniformly charging an image frame of a moving photoconductive member, or photoreceptor, to a substantially uniform potential, and imagewise discharging it or imagewise exposing it to light reflected from an original image being copied or reproduced. The result is an electrostatically formed latent image on the image frame of the photoconductive member. For multiple original images, several such frames are similarly imaged. The latent image so formed on each frame is developed by bringing a charged developer material into contact therewith. Two-component and singlecomponent developer materials are commonly used. A typical two-component developer material comprises magnetic carrier particles, also known as "carrier beads," having fusable charged toner particles adhering triboelectrically thereto. A single component developer material typically comprises charged toner particles only.

In either case, the fusable charged toner particles when brought into contact with each latent image, are attracted to such image, thus forming a toner image on the photoconductive member. The toner image is subsequently transferred at a transfer station to an image receiver or copy sheet. The copy sheet is then passed through a fuser apparatus where the toner image is heated and permanently fused to the copy sheet forming a hard copy of the original image.

Original documents to be copied one by one at such a copying machine frequently come in the form of a stapled set, fastened together at least in one spot, by a staple. As is well known, the fastening staple has a crown portion and leg portions that pierce through the set of document sheets from a first side, and are then clinched or bent against the second or opposite side of the set of document sheets. A copying machine operator usually has to remove the staple or staples from the set of document sheets before copying each such document sheet, usually one by one.

For removing such staples, hand held staple removers of the type disclosed, for example, in U.S. Pat. No. 4,903,945, usually are used. Typically, an area of the top panel of the copying machine, occasionally including a shallow dip or surface recess, is used as a working surface for removing such staples using the hand-held staple remover. Ordinarily, there is a problem with removed and loose staples when they are carelessly left in this area on the machine, even in the shallow surface recess. Such loose staples can cause even more problems if they drop into the machine operating area.

As disclosed in U.S. Pat. No. 4,473,220 attempts to solve the above problems have included, for example, a passive fixed position finger that has a sharp tip projecting over a tray in a recess, as well as, projecting upwardly above the surrounding surface for removing staples from stapled sets. Such upward projection of the sharp tip of the finger is obviously not very safe. To remove a staple using the finger, an operator must manually position, and then push a stapled set of sheets over the tip of the finger so that the sharp tip engages and horizontally prys the staple from the set. The finger tip is towards its end in order to cause the staple, if properly engaged, to be pried free or removed from the stapled set.

Unfortunately, however, this finger staple remover will tend to leave the removed staple still clinging onto the finger, as is commonly the experience with hand-held staple removers of the sort. This finger also utilizes unopposed horizontal shearing forces for prying the staple. The shearing forces understandably will tend to cause the staple to rip or tear the sheets, particularly since the force to be provided is by the push of an operator with no guidance.

SUMMARY OF THE INVENTION

In accordance with the present invention, there is provided a powered staple remover associated with a frame of a reproduction machine for effectively and safely removing clinched staples from a stapled set of document sheets. The powered staple remover includes an elongate member for holding between a thumb and fingers of a user's hand. The elongate member has walls defining a cavity, a first end, a second end, and an opening into the cavity through the second end. The powered staple remover also includes first and second staple crown grippers mounted within the cavity towards the second end, at least one gripper of the first and second staple crown grippers is moveable towards the other. The powered staple remover further includes a powered device connected to the at least one gripper for moving the at least one gripper from an open to a closed position, and from and towards the second end, thereby effortlessly and effectively removing a clinched staple from a stapled set of sheets without damage to the set of sheets. The powered staple remover includes an attaching device for attaching the elongate member to an electrostatographic reproduction machine.

BRIEF DESCRIPTION OF THE DRAWINGS

In the detailed description of the invention presented below, reference is made to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
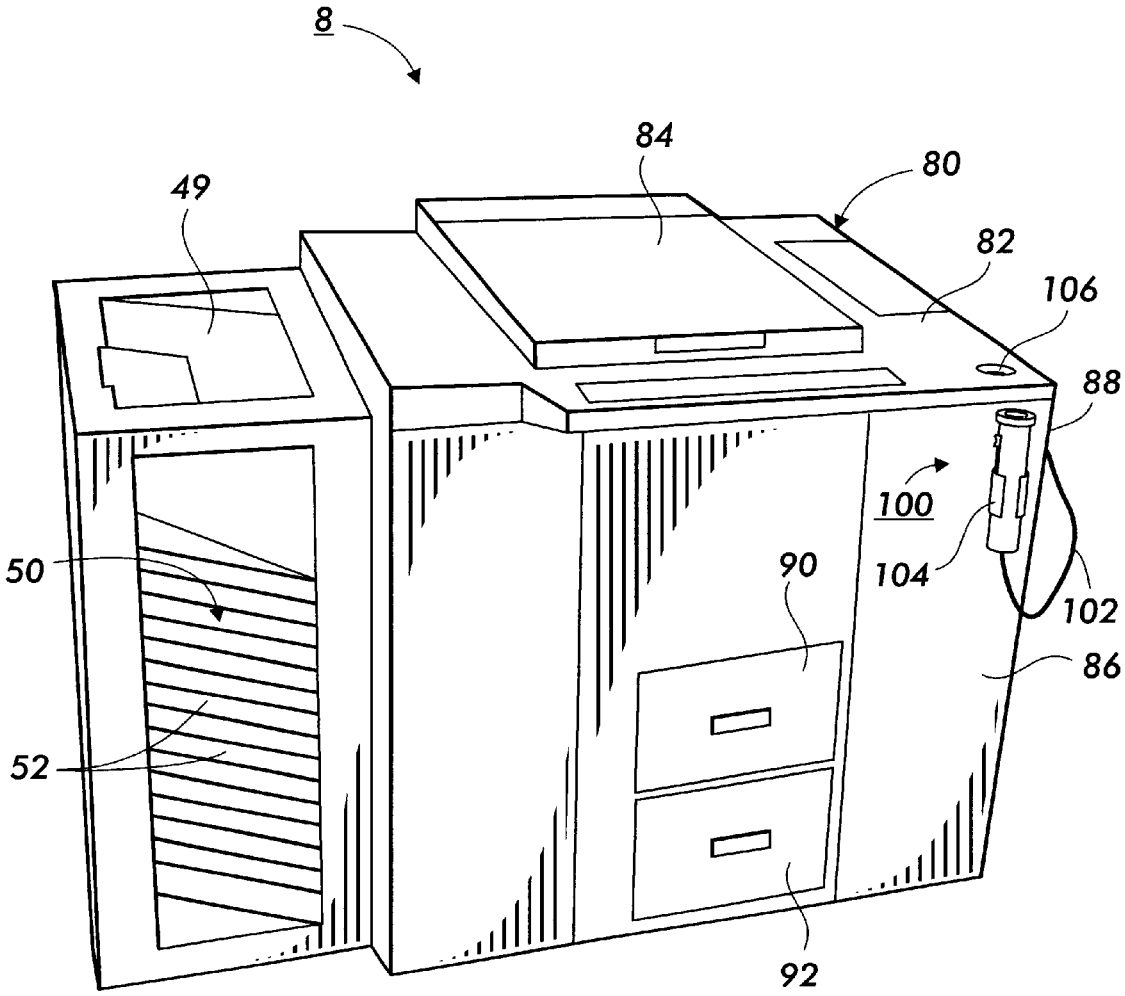
FIG. 1 is an external view of a copying machine including the powered staple remover of the present invention.

Referring first to FIG. 1, the copying machine 8 is illustrated externally to show an exemplary location of the powered staple remover of the present invention. Externally, the copying machine 8 includes a frame shown generally as 80 including a top horizontal frame panel 82. The top horizontal panel 82 includes a platen cover 84, and could instead include an automatic document handler (not shown), as well as an output tray 49. Copies of original documents reproduced by the process of the machine 8 can be collected as described above in a bin sorter apparatus 50 having individual bins 52. The frame 82 also includes a front vertical panel 86 that has openings for copy sheet supply trays 90, 92, for example, and that forms a corner 88 with the top horizontal panel 82. As illustrated, the powered staple remover is preferably located at the comer 88.

Figure 2:
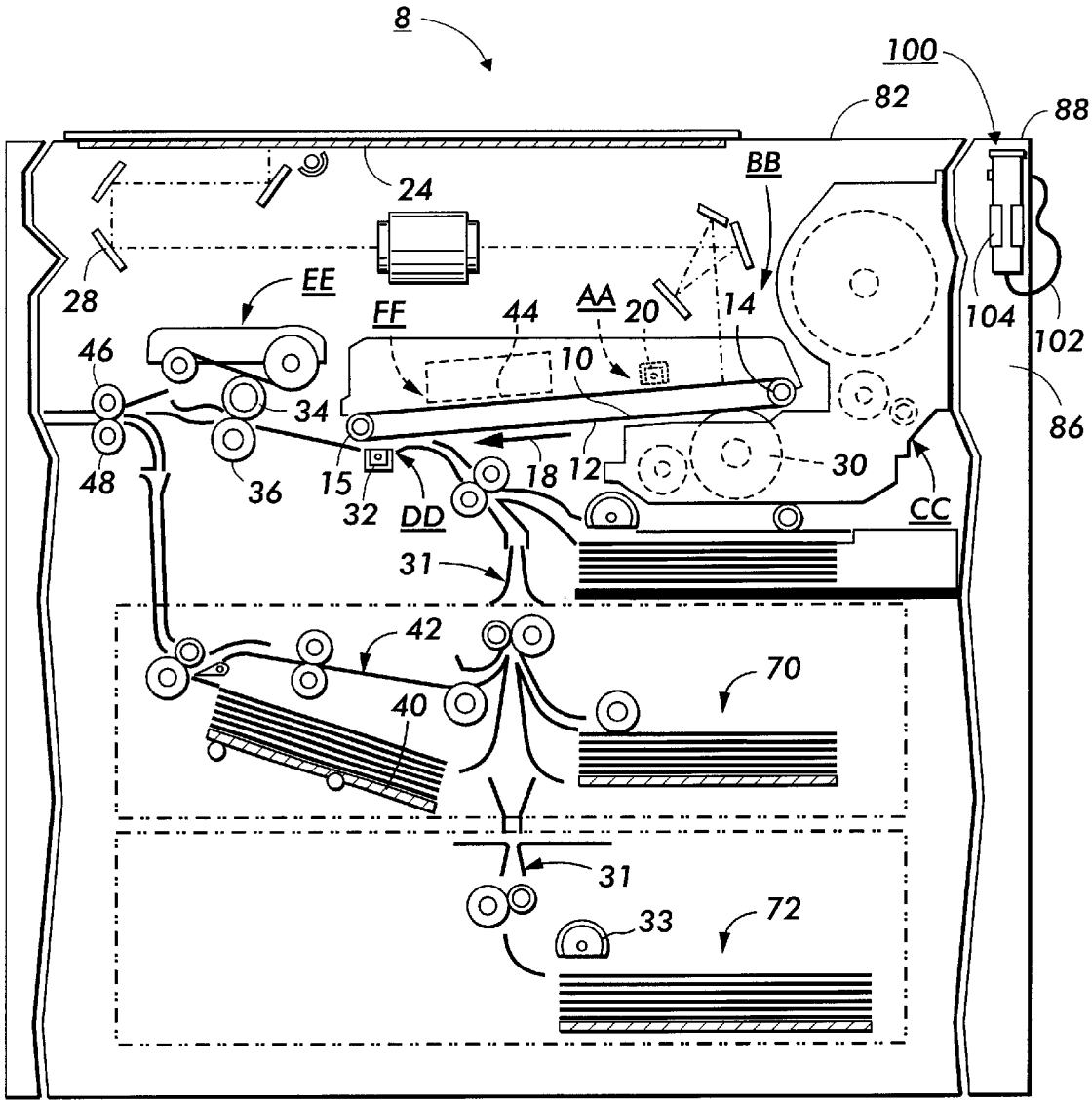
FIG. 2 is a vertical schematic view of the internal process components and stations of the copying machine of FIG. 1.

Referring next to FIG. 2, the machine 8 has conventional imaging processing stations associated therewith, including a charging station AA, an imaging/exposing station BB, a development station CC, a transfer station DD, a fusing station EE, and a cleaning station FF. Importantly, the machine 8 includes a convenience active staple removing station of the present invention (to be described in detail below), As shown, the machine 8 has a photoconductive belt 10 with a photoconductive layer 12 which is supported by a drive roller 14 and a tension roller 15. The drive roller 14 functions to drive the belt in the direction indicated by arrow 18. The drive roller 14 is itself driven by a motor (not shown) by suitable means, such as a belt drive.

The operation of the machine 8 can be briefly described as follows. Initially, the photoconductive belt 10 is charged at the charging station AA by a corona generating device 20. The charged portion of the belt is then transported by action of the drive roller 14 to the imaging/exposing station BB where a latent image is formed on the belt 10 corresponding to the image on a document positioned on a platen 24 via the light lens imaging system 28 of the imaging/exposing station BB. It will also be understood that the light lens imaging system can easily be changed to an input/output scanning terminal or an output scanning terminal driven by a data input signal to likewise image the belt 10. As is also well known, the document on the platen 24 can be placed there manually, or it could be fed there automatically by an automatic document handler device (not shown).

The portion of the belt 10 bearing the latent image is then transported to the development station CC where the latent image is developed by electrically charged toner material from a magnetic developer roller 30 of the developer station CC. The developed image on the belt is then transported to the transfer station DD where the toner image is transferred to a copy sheet fed from a sheet cassette tray, for example, sheet cassette tray assemblies 70, 72. As shown, the sheets are fed, for example, by a copy sheet handling system 31 that each includes a feed roller 33.

At the transfer station DD, a corona generating device 32 is provided for charging the copy sheet so as to attract the charged toner image from the photoconductive belt 10 to the copy sheet. The copy sheet with the transferred image thereon is then directed to the fuser station EE. The fuser apparatus at station EE includes a heated fuser roll 34 and backup pressure roll 36. The heated fuser roll 34 and pressure roll 36 rotatably cooperate to fuse and fix the toner image onto the copy sheet. The copy sheet then, as is well known, may be selectively transported to the finishing area, or to a duplex tray 40 along a selectable duplex path 42 for duplexing.

The portion of the belt 10 from which the developed image was transferred is then advanced to the cleaning station FF where residual toner and charge on the belt are removed by a cleaning device such as a blade 44, and a discharge lamp (not shown) in order to prepare the portion for a subsequent imaging cycle.

When not doing duplex imaging, or at the end of such duplex imaging, the copy sheets upon finally leaving the fusing rolls 34, 36, are passed to rolls 46 and 48 for input to the finishing area. From the input rolls 46, 48, the copy sheets are fed, for example, individually to an output tray 49, or to a bin sorter apparatus 50 where the sheets can be arranged in a collated unstapled set within the tray or within each bin 52 of the bin sorter apparatus 50.

Referring now to FIGS. 1–4, the powered staple remover of the present invention can for example be an electrically operated device for removing clinched staples from sets of document sheets in a manner that requires minimal physical effort from the operator, and that produces minimal damage to original documents sheets in the stapled set.

Conventional staple removers, such as the commonly used simple caliper type hand held manual staple remover, are difficult to use, can require a lot of physical effort if the set of document sheets is thick. Unfortunately, damage usually occurs to sheets of such a set during such a staple removal process. It is often the case that an operator arrives at a copier with a stapled document with no device available for assisting in staple removal prior to copying.

In accordance with the present invention, document processing machines such as copiers, and fax machines would be fitted with the powered staple remover 100 that is attached thereto with a simple, non-removable device 102, thereby enabling, prior to copying/faxing, effortless and effective removing of a clinched staple from a stapled set of sheets without damage to the set of sheets.

The powered staple remover would of course be connected to a source of power such as an electrical power source (not labeled), which in the case of an electric motor, would be supplied by the machine via a coiled telephone type cable 102 (serving also as the attaching device) for example. Battery operated versions could also be produced if required. The source of power can equally be compressed air in the case of a pneumatic drive device. The powered staple remover would be held in the hand similar to a pen during operation. As shown, a holder such as a clamp 104 or magnetic pad, is provided on the machine for holding the powered staple remover 100 when not in use. A magnetic cup or recess 106 can be provided on the copier machine frame 86 for holding removed staples.

Figure 3:
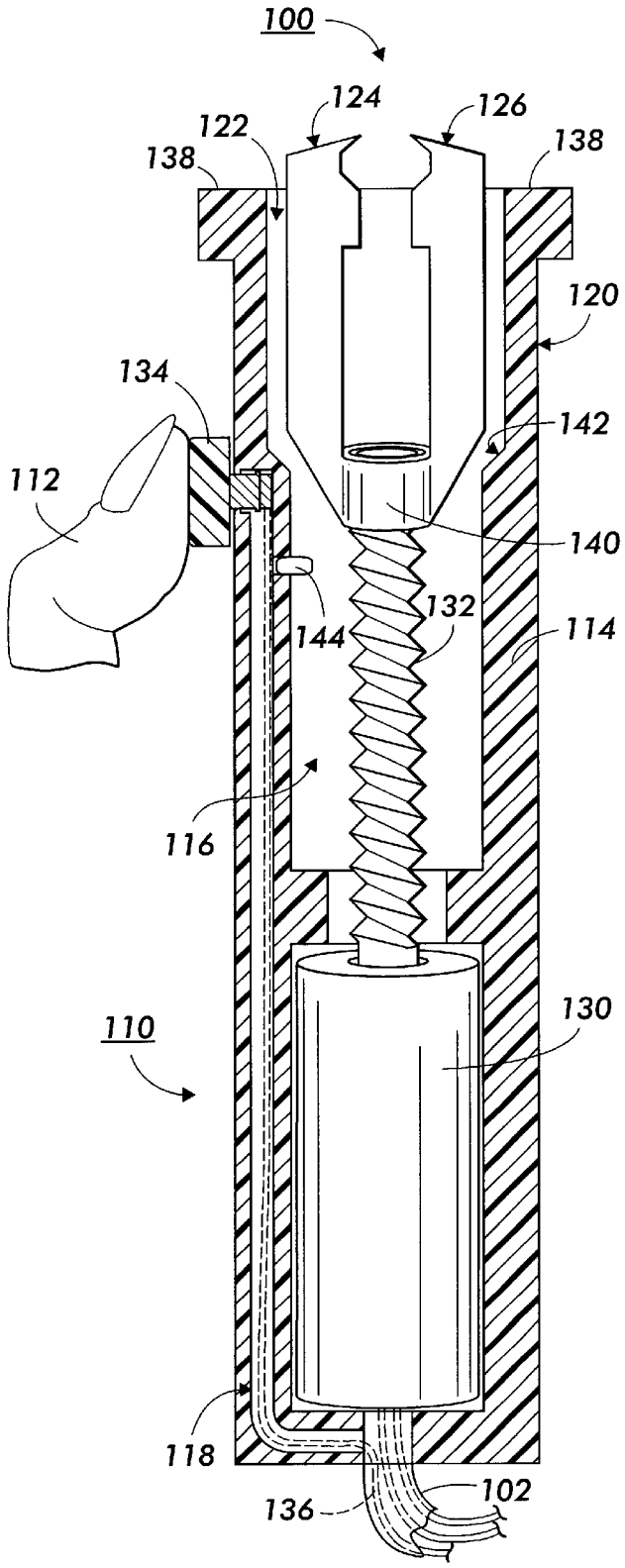
FIG. 3 is a sectional illustration of the powered staple remover of the present invention showing its first and second jaws in their open position.
Figure 4:
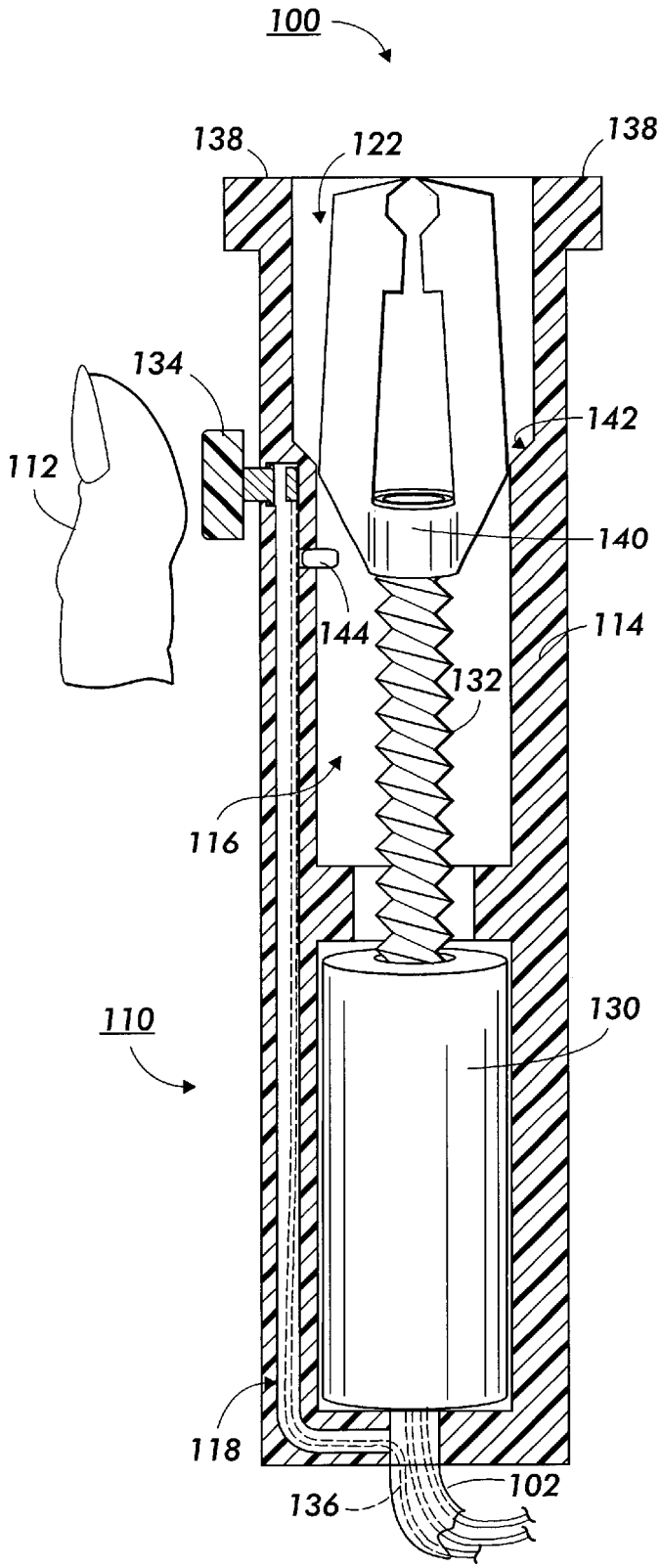
FIG. 4 is a sectional illustration of the powered staple remover of the present invention showing its first and second jaws in their closed and retracting position.

Referring now to FIGS. 3–4, the powered staple remover 100 as shown includes an elongate member 110 for holding between a thumb 112 and fingers of a user's hand. The elongate member 110 that is cylindrical and includes walls 114 defining a cavity 116, a first end 118, a second end 120, and an opening 122 into the cavity 116, through the second end 120. The powered staple remover 100 also includes first and second staple crown grippers 124, 126, that as shown are mounted within the cavity 116 at the second end 120, and at least one of the grippers is moveable. The powered staple remover 100 further includes powered means, such as an electric motor 130 and a drive shaft 132, that are mounted within the cavity 116 and connected to the at least one gripper for moving the at least one gripper from an open position (FIG. 3) to a closed position (FIG. 4), and from and towards the second end 120. The powered electrical motor 130 and drive shaft 132 thereto are coupled to the first and second staple crown grippers. Such movements advantageously enable effortless and effective removing of a clinched staple from a stapled set of sheets, without damage to the set of sheets.

As further illustrated, the powered staple remover 100 includes user control means such as a button 134 and an electric connector 136 for starting and stopping the powered means or motor 130. The walls 114 include a flat portion 138 at the second end for forming an anvil to hold back and protect document sheets from which a clinched staple is being removed. The first and second staple crown grippers 124, 126 comprise first and second staple crown gripping jaws that are moveable towards and away from each other. As pointed out above, the powered staple remover 100 includes means 102 for attaching the elongate member 110 to a frame of a document reproduction machine such that the elongate member 110 is manually maneuverable.

As also shown, the at least one gripper 124, 126 is, and preferably both are, mounted within the cavity 116 such that they project outwardly of the cavity 116 beyond the flat portion 138 when idle and about to be operated. The drive shaft 132 is threaded preferably, and is engaged with a threaded portion (internal surface of a collar portion 140) of the at least one gripper 124, 126. The electrical motor 130 is a D.C. motor, and is reversibly rotatable, along with drive shaft 132 to move the at least one gripper 124, 126 away from and back to the second end 120. The powered staple remover further includes a first limit switch for stopping a driving action of the electrical motor and the drive shaft 132 when driving and moving the at least one gripper 124, 126 away from the second end 120. The at least one staple crown gripper 124,126 is, and preferably both are, pivotably moveable toward another.

To operate, an operator hooks at least one of the jaws or gripper 124, 126 onto a clinched staple to be removed from a set of document sheets. Pressing the button 134 then causes the motor 130 to rotate in the extract direction. The jaws or gripper 124, 126 meanwhile clamp together as they retract past chamfered edges 142 in the walls 114, The jaws or gripper 124, 126, complete with a clamped staple, are thus retracted into the cavity 1 16. The electric connector 136 is such that the motor 130 will continue to drive and retract until the button 134 is released or until a limit switch 144 is activated. The retraction distance is long enough to extract largest staple sizes. On releasing the button, the motor reverses, moving the jaw assembly and staple out of the body until another limit switch is activated to stop the motor. At such point, gripping pressure is removed from the jaws, thus releasing the removed staple.

As can be seen, there has been provided a powered staple remover including an elongate member for holding between a thumb and fingers of a user's hand. The elongate member has walls defining a cavity, a first end, a second end, and an opening into the cavity through the second end. The powered staple remover also includes first and second staple crown grippers mounted within the cavity towards the second end, at least one gripper of the first and second staple crown grippers is moveable towards the other. The powered staple remover further includes a powered device connected to the at least one gripper for moving the at least one gripper from an open to a closed position, and from and towards the second end, thereby effortlessly and effectively removing a clinched staple from a stapled set of sheets without damage to the set of sheets. The powered staple remover includes an attaching device for attaching the elongate member to an electrostatographic reproduction machine.

While this invention has been described in conjunction with a specific embodiment thereof, it is evident that many alternatives, modifications and variations will be apparent to those skilled in the art. Accordingly, it is intended to embrace all such alternatives, modifications and variations that fall within the spirit and broad scope of the appended claims.

What is claimed:

1. A powered staple remover comprising:

a. an elongate member for holding between a thumb and fingers of a user's hand, said elongate member including walls defining a cavity, a first end, a second end, and an opening into said cavity, through said second end;

b. first and second staple crown grippers mounted within said cavity at said second end, at least one gripper of said pair of staple crown grippers being moveable; and c. powered means mounted within said cavity and connected to said at least one gripper for moving said at least one gripper from an open position to a closed position, and from and towards said second end, thereby effortlessly and effectively removing a clinched staple from a stapled set of sheets without damage to the set of sheets.

2. The powered staple remover of claim 1, including user control means for positioning said at least one gripper to a crown of a staple to be removed, and for starting and stopping said powered means.

3. The powered staple remover of claim 1, wherein said powered means comprises an electrical motor assembly.

4. The powered staple remover of claim 3, wherein said electrical motor assembly includes a powered motor and a drive shaft thereto coupled to said pair of staple crown grippers.

5. The powered staple remover of claim 4, wherein said drive shaft is threaded and is engaged with a threaded portion of said at least one gripper.

6. The powered staple remover of claim 4, wherein said powered motor is a D.C. motor.

7. The powered staple remover of claim 4, wherein said powered motor and said drive shaft are reversibly rotatable to move said at least one gripper away from and back to said second end.

8. The powered staple remover of claim 7, wherein including a limit switch for stopping a driving action of said powered motor and said drive shaft when driving and moving said at least one gripper away from said second end.

9. The powered staple remover of claim 7, wherein at least one staple crown gripping portion of said staple crown gripping portions is pivotably moveable toward one another.

10. The powered staple remover of claim 9, wherein said at least one staple crown gripping portion and a portion of one of said walls adjacent thereto are manually pivotable towards one another.

11. The powered staple remover of claim 1, wherein said elongate member is cylindrical.

12. The powered staple remover of claim 1, wherein said walls include a flat portion at said second end forming an anvil for holding back and protecting document sheets from which a clinched staple is being removed.

13. The powered staple remover of claim 12, wherein said at least one gripper is mounted within said cavity such that it project outwardly of said cavity beyond said flat portion.

14. The powered staple remover of claim 1, wherein said first and second staple crown grippers comprise first and second staple crown gripping jaws, said staple crown gripping jaws being moveable towards and away from each other.

15. The powered staple remover of claim 1, wherein staple crown gripping portions of said pair of staple crown grippers have an open position apart, and a staple crown gripping position towards one another.

16. The powered staple remover of claim 1, including means for attaching said elongate member to a document reproduction machine such that said elongate member is manually maneuverable.

17. A reproduction machine for producing sheet copies of sheet original documents, the reproduction machine comprising:

(a) a machine frame;

(b) means supported within said machine frame including an image bearing member, for forming a toner image of an original image of a sheet document;

(c) means for transferring said toner image onto a copy sheet;

(d) means including a platen for holding and exposing an original image of a sheet original document onto said image bearing member; and (e) powered staple remover attached to said frame of the machine and including:

(i) an elongate member for holding between a thumb and fingers of a user's hand, said elongate member including walls defining a cavity, a first end, a second end, and an opening into said cavity, through said second end;

(ii) first and second staple crown grippers mounted within said cavity at said second end, at least one gripper of said pair of staple crown grippers being moveable; and (iii) powered means mounted within said cavity and connected to said at least one gripper for moving said at least one gripper from an open position to a closed position, and from and towards said second end, thereby effortlessly and effectively removing a clinched staple from a stapled set of sheets without damage to the set of sheets.

* * * * *